US011067071B2

(12) United States Patent
Pavan et al.

(10) Patent No.: US 11,067,071 B2
(45) Date of Patent: Jul. 20, 2021

(54) CYLINDER HEAD FOR COMPRESSOR

(71) Applicant: SABIC Global Technologies B.V., Bergen op Zoom (NL)

(72) Inventors: Puranik Pavan, Bangalore (IN); Arunachala Parameshwara, Bangalore (IN); Anil Tiwari, Bilaspur (IN); Subhransu Sekhar Mohapatra, Bangalore (IN); Walter Thompson, Wilmington, DE (US); Jay Whalen, Hermitage, PA (US); Matthew Buratto, Lee, MA (US); Mayank Mistry, Land O Lakes, FL (US)

(73) Assignee: SABIC GLOBAL TECHNOLOGIES B.V., Bergen Op Zoom (NL)

( * ) Notice: Subject to any disclaimer, the term of this patent is extended or adjusted under 35 U.S.C. 154(b) by 388 days.

(21) Appl. No.: 15/752,067

(22) PCT Filed: Aug. 12, 2016

(86) PCT No.: PCT/US2016/046850
§ 371 (c)(1),
(2) Date: Feb. 12, 2018

(87) PCT Pub. No.: WO2017/030986
PCT Pub. Date: Feb. 23, 2017

(65) Prior Publication Data

US 2018/0238316 A1 Aug. 23, 2018

(30) Foreign Application Priority Data

Aug. 14, 2015 (IN) ..... 2512/DEL/2015

(51) Int. Cl.
*F04B 39/12* (2006.01)
*F04B 53/00* (2006.01)
*F25B 1/02* (2006.01)

(52) U.S. Cl.
CPC ..... *F04B 39/125* (2013.01); *F04B 39/122* (2013.01); *F04B 53/007* (2013.01); *F25B 1/02* (2013.01); *F05C 2225/00* (2013.01)

(58) Field of Classification Search
CPC .... F04B 39/125; F04B 53/007; F04B 39/122; F25B 1/02
See application file for complete search history.

(56) References Cited

U.S. PATENT DOCUMENTS 3,986,798 A 10/1976 Lindell et al.
4,671,065 A * 6/1987 Ishiwata ..... B29C 37/005 60/533
4,784,581 A 11/1988 Fritchman
4,870,827 A * 10/1989 McFarlin ..... F04B 39/126 62/6

(Continued)

FOREIGN PATENT DOCUMENTS

CN 104728085 A 6/2015
CN 104791213 A 7/2015

(Continued)

OTHER PUBLICATIONS

Nandi, Swapan Kumar; "Finite Element Analysis for Acoustic Behavior of a Refrigeration Compressor"; Tata Consultancy Services; no date; 10 pages.

(Continued)

*Primary Examiner* — Abiy Teka
(74) *Attorney, Agent, or Firm* — Cantor Colburn LLP

(57) ABSTRACT

A cylinder head for a compressor is disclosed. A compressor is also disclosed including the head. A refrigeration system is also disclosed, including the compressor.

19 Claims, 8 Drawing Sheets

(56) References Cited

U.S. PATENT DOCUMENTS

| | | | | |
|---|---|---|---|---|
| 5,131,827 | A | 7/1992 | Tasaka | |
| 6,464,475 | B1 | 10/2002 | Bertolini | |
| 2003/0180161 | A1* | 9/2003 | Hsiao | F04B 39/0016 417/313 |
| 2014/0010679 | A1 | 1/2014 | Rice et al. | |

FOREIGN PATENT DOCUMENTS

| | | | |
|---|---|---|---|
| EP | 0561383 | A1 | 9/1993 |
| EP | 2884104 | A1 | 6/2015 |
| WO | WO 2009/071384 | A1 | 6/2009 |

OTHER PUBLICATIONS

Kara et al.; "Thermal Analysis of a Small Hermetic Reciprocating Compressor"; Int'l Compressor Engineering Conference; 2010; 9 pages.

Rao et al.; "Analysis of Refrigerator Compressor Using CFD"; Int'l Compressor Engineering Conference; 2004; 8 pages.

Warminska et al.; "Analysis of Energy Losses in Small Compression Refrigerators"; DINCON; 9$^{th}$ Brazilian Conf. on Dynamics, Control and their Applications; 2010; p. 782-789.

Jorwekar et al.; "Cylinder Head Gasket Contact Pressure Simulation for a Hermetic Compressor"; Int'l Compressor Engineering Conference; 2006; 6 pages.

International Patent Application No. PCT/US2016/046850; Int'l Search Report and the Written Opinion; dated Oct. 24, 2016; 11 pages.

International Patent Application No. PCT/US2016/046850; Int'l Preliminary Report on Patentability; dated Mar. 1, 2018; 8 pages.

* cited by examiner

CYLINDER HEAD FOR COMPRESSOR

CROSS REFERENCE TO RELATED APPLICATIONS

This application is the National Stage of International Application No. PCT/US2016/046850 filed Aug. 12, 2016, which claims the benefit of Indian Application No. 2512/DEL/2015, filed Aug. 14, 2015, the disclosures of which are incorporated herein by this reference in their entireties.

BACKGROUND

Compressors are commonly used to compress various fluids, such as gasses. Reciprocating compressors typically include a cylinder having a chamber that houses a reciprocating piston, and a cylinder head that encloses the cylinder. During a first intake stroke of the piston, negative pressure builds up in the chamber that draws fluid into the cylinder chamber through an inlet. During a second discharge stroke of the piston positive pressure builds up in the chamber, which forces fluid that has been drawn into the chamber during the intake stroke out of the chamber through the outlet. Compressors typically include a discharge valve at the outlet. The discharge valve allows fluid to flow from the chamber through the outlet once the positive pressure in the chamber is sufficient to open the discharge valve, but prevents fluid from flowing into the chamber from the outlet during the intake stroke. Compressors further typically include an inlet valve at the inlet. The inlet valve allows fluid to flow into the chamber through the inlet once the negative pressure in the chamber is sufficient to open the inlet valve, but prevents fluid from flowing out of the inlet from the chamber during the discharge stroke.

Compressors find applications in any number of systems. One such application is a refrigeration system, whereby a compressor receives gaseous refrigerant from an evaporator, and compresses the refrigerant to raise the pressure of the refrigerant. The compressed gaseous refrigerant then travels from the compressor to a condenser, where heat is removed from the refrigerant. The refrigerant undergoes a phase change in the condenser from a gas to a liquid. The liquid refrigerant travels through an expansion valve whereby the refrigerant undergoes a pressure drop. The liquid refrigerant then flows to the evaporator, where it removes heat from the space that is to be cooled, and evaporates into a gas. The gas travels to the compressor as described above.

The compressor often consumes the majority of power in a typically refrigeration system. Thus, the efficiency of the compressor has a great effect on the overall efficiency of the refrigeration system. However, while attending to efficiency issues, care is also taken to ensure that the compressor is reliable in the face of severe working conditions due to the high pressures and temperature associated with the refrigerant during operation of the compressor.

SUMMARY

The following Summary is provided to introduce a selection of concepts in a simplified form that are further described below in the Detailed Description. This Summary is not intended to identify key features or essential features of the invention, nor is it intended to be used to limit the scope of the invention. Reference is made to the claims for that purpose.

In one aspect of the present disclosure, a cylinder head is provided for attachment to a cylinder body of a compressor.

The cylinder body can include an outer wall having an inner body surface and an outer body surface opposite the inner body surface, wherein the inner body surface partially defines a cylinder chamber. The cylinder head defines an inner head surface that faces the cylinder chamber, an outer head surface that is opposite the inner head surface along a central head axis, and a side wall configured to attach to the cylinder body. The outer head surface defines a concavity along at least one direction. It has been found that the concavity provides high stiffness to the cylinder head against internal pressure in the cylinder chamber. Thus, in one example, the cylinder head deflects less than conventional cylinder heads that do not include the concavity.

BRIEF DESCRIPTION OF THE DRAWINGS

The foregoing summary, as well as the following detailed description, is better understood when read in conjunction with the appended drawings. There is shown in the drawings example embodiments. The present invention is not intended to be limited to the specific embodiments and methods disclosed, and reference is made to the claims for that purpose.

DETAILED DESCRIPTION

Figure 1B:
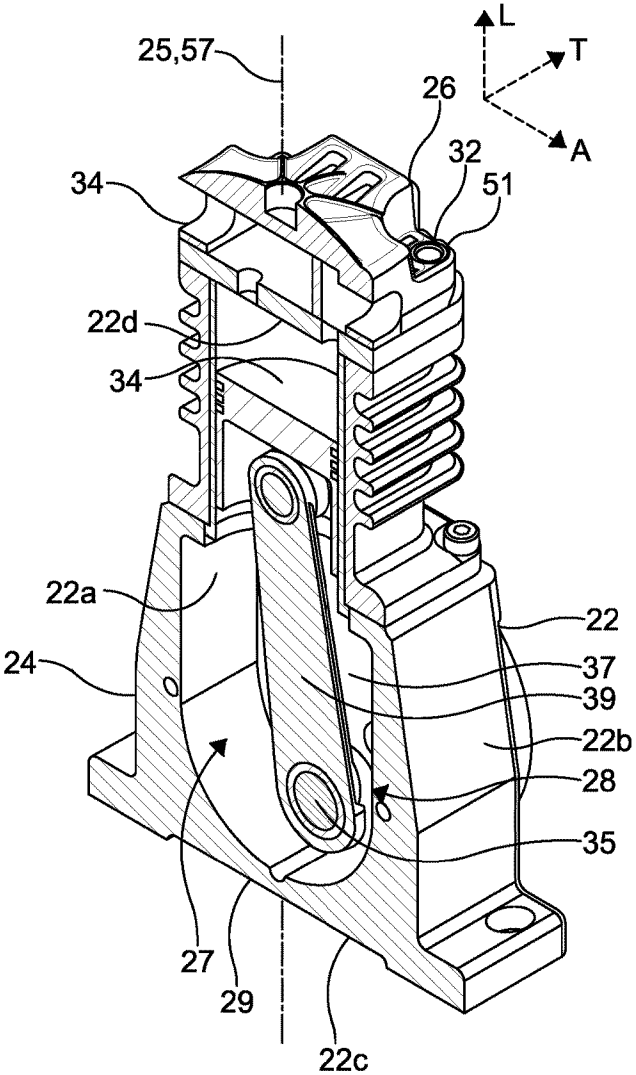
FIG. 1B is a sectional side elevation view of the reciprocating compressor illustrated in FIG. 1A, taken along line 1B-1B.
Figure 1A:
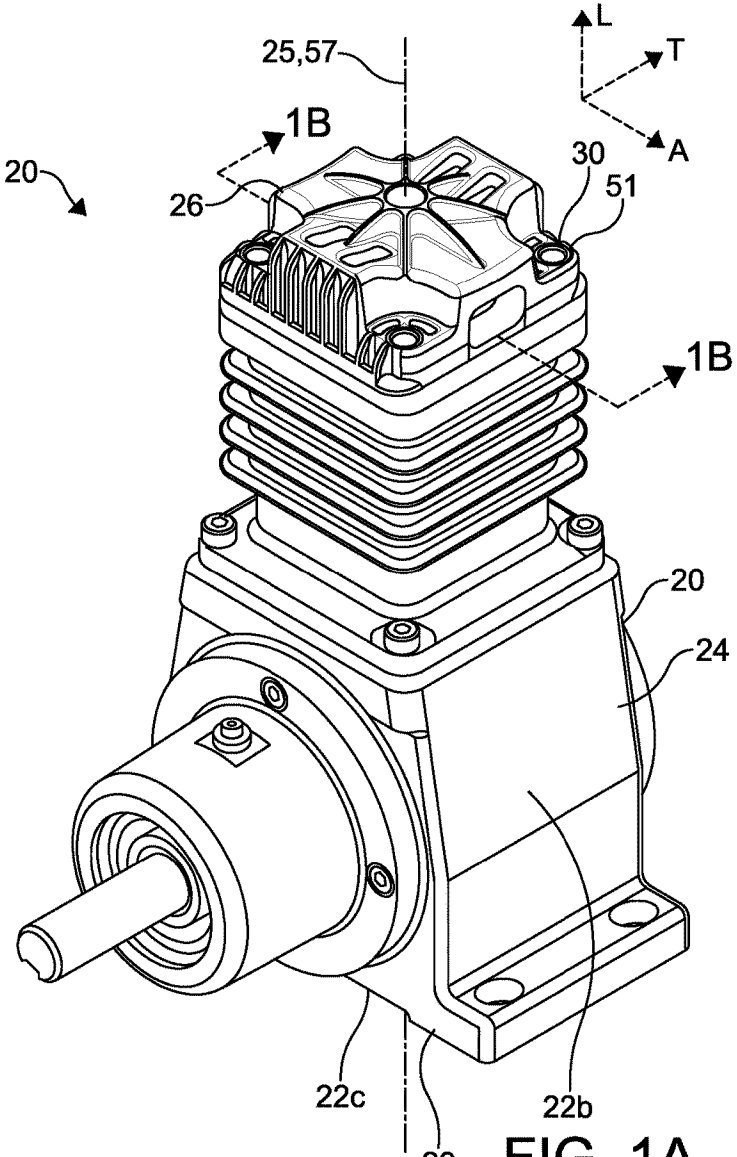
FIG. 1A is a perspective view of a reciprocating compressor constructed in accordance with one embodiment, including a cylinder and a cylinder head.

FIGS. 1A-1B illustrate a compressor 20 that includes a cylinder body 22 having an outer wall 24. The compressor 20 further includes a cylinder head 26 that is configured to attach to the cylinder body 22 so as to substantially enclose a cylinder chamber 28. The cylinder chamber 28 can be referred to as substantially enclosed in that the cylinder chamber 28 is enclosed with the exception of an inlet 30 and an outlet 32 that each extend into the cylinder chamber 28. The compressor 20 further includes a piston 34 that is supported in the cylinder chamber 28 by a shaft 35. In particular, the compressor can include a connecting rod 39 that is connected between the piston 34 and the shaft 35. During operation, the shaft 35 is rotatable so as to cause the piston 34 to move cyclically along a longitudinal direction L between an intake stroke and a discharge stroke. During the intake stroke, the piston 34 moves away from the cylinder head 26 so as to create a negative pressure in the cylinder chamber 28. The negative pressure draws fluid 27 into the cylinder chamber 28 through an inlet 30. During the discharge stroke, the piston 23 moves toward the cylinder head 26 so as to compress the fluid 27 and create a positive pressure in the cylinder chamber 28.

The cylinder body 22 defines an inner body surface 22*a* and an outer body surface 22*b* opposite the inner body surface 22*a*. The inner body surface 22*a* partially defines the cylinder chamber 28. The cylinder body 22 further defines a first end 22*c* and a second end 22*d* opposite the first end with respect to the longitudinal direction L. The cylinder body 22 can include a base 29 at the first end 22*c*, such that the first end 22*c* can be closed. The second end 22*d* can be open. The cylinder head 26 can be attached to the cylinder body 22 at the second end 22*d*. The shaft 35 can extend through the outer wall 24 of the cylinder body 22 and into the cylinder chamber 28 along a first direction, such as a transverse direction T, that can be substantially (e.g, within manufacturing tolerance) perpendicular to the longitudinal L. The shaft 35 can extend eccentrically from a bearing 37 hat is configured to rotate and cause the piston to reciprocally move between the intake stroke and the discharge stroke. The interface between the bearing 37 and the outer wall 24 can be sealed so as to prevent the leakage of fluid in and out of the interface.

The compressor 20 further includes an intake valve that allows the fluid 27 to flow into the cylinder chamber 28 through the inlet 30 under negative pressure in the cylinder chamber 28, and prevents the fluid 27 from flowing out of the cylinder chamber 28 through the inlet 30 under positive pressure in the cylinder chamber 28. For instance, the intake valve can be configured as a flap that overlies the inlet 30. Once the negative pressure inside the chamber 28, for instance between the piston 34 and the cylinder head 26, accumulates to a suitable level, the negative pressure causes the intake valve to open, thereby drawing the fluid 27 into the chamber 28. For instance, the fluid 27 can be drawn into the chamber at a location between the piston 34 and the cylinder head 26.

The compressor 20 further includes a discharge valve that allows fluid 27 to flow out of the cylinder chamber 28 through the outlet 32 under positive pressure in the cylinder chamber 28, and prevents fluid 27 from flowing through the outlet 32 and into the cylinder chamber 28 under negative pressure in the cylinder chamber. For instance, the intake valve can be configured as a flap that overlies the outlet 32. Once the positive pressure inside the chamber 28, for instance between the piston 34 and the cylinder head 26, accumulates to a suitable level, the positive pressure causes the discharge valve to open, thereby driving the compressed fluid 27 out of the chamber 28 through the outlet 32. For instance, the fluid 27 that is driven out of the chamber 28 can reside in the chamber 28 between the piston 32 and the cylinder head 26.

In one application, the compressor 20 can be included in a refrigeration system, such that the fluid 27 comprises a refrigerant. In this regard, the compressor 20 can draw the fluid 27 into the cylinder chamber 28 through the inlet 30 from an evaporator of the refrigeration system. The compressor 20 can compress the fluid 27 to raise the pressure of the fluid 27, and output the fluid 27 to a condenser of the refrigeration system. It should be appreciated that the fluid 27 can be in a gaseous phase both when it is drawn into the cylinder chamber 28 through the inlet 30 and when it is discharged from the cylinder chamber 28 through the outlet. The fluid 27 then travels from the compressor to a condenser of the refrigeration system, where heat is removed from the fluid. The fluid 27 undergoes a phase change in the condenser from the gaseous phase to a liquid phase. The liquid fluid 27 travels through an expansion valve of the refrigeration system, whereby the fluid 27 undergoes a pressure drop. The liquid fluid 27 then flows from the expansion valve to the evaporator, where it removes heat from the space that is to be cooled, and evaporates into a gaseous phase. The gaseous fluid 27 then flows into the cylinder chamber 28 in the manner described above.

The cylinder head 26 includes a closure member 40 that defines an inner head surface 26*a* that faces the cylinder chamber 28 when the cylinder head 26 is attached to, or otherwise supported by, the cylinder body 22, and in particular the outer wall 24, and the second end 22*d*. Thus, the inner head surface 26*a* can partially define the substantially closed cylinder chamber 28. The closure member 40, and thus the cylinder head 26, further defines an outer head surface 26*b* that is generally opposite the inner head surface 26*a* along the longitudinal direction L. The inner head surface 26*a* can be aligned with the cylinder chamber 28 along the longitudinal direction L. Similarly, the outer head surface 26*b* can be aligned with the cylinder chamber 28 along the longitudinal direction L. Thus, the inner head surface 26*a* can be aligned with the outer head surface 26*b* along the longitudinal direction L. The cylinder head 26 further includes a side wall 42 that extends from the closure member 40. In particular, the side wall 42 can extend from the closure member 40 in a direction that is defined from the second end 22*d* of the cylinder body 22 toward the first end 22*c* of the cylinder body 22.

The side wall 42 can define an outer perimeter of the cylinder head 26. For instance, the side wall 42 can define a plurality of sides 43 that define the outer perimeter of the cylinder head 26. The plurality of sides 43 can cooperate to impart a round, such as circular, shape to the side wall 42. Alternatively, one or more up to all of the plurality of sides 43 can be substantially linear so as to define a rectangular of other polygonal shape. The cylinder head 26 can include a plurality of recesses 49 that extend into the side wall 42, for instance at intersections between adjacent ones of the sides 43. The recesses can extend from the outer head surface 26*b* toward but not through the inner head surface 26*a*. The cylinder head 26 can include mounting apertures 51 that extend through the closure member 40 at the recesses 49. The recesses 49 are configured to receive fasteners, such as screws or bolts or the like, that attach the cylinder head 26 to the cylinder body 22, and in particular to the outer wall 24. Thus, the cylinder head 26 can be separate from the cylinder body 22 and configured to be attached to the cylinder body 22 in any manner desired, for instance at the second end 22*d*. The cylinder head 26 can define an interior space 44 that is defined by the side wall 42 and the closure member 40. The interior space 44 of the cylinder head 26 can define a portion of the cylinder chamber 28 when the cylinder head 26 is attached to the cylinder chamber 28. It is appreciated that the size and shape of the cylinder body 22, the cylinder head 26, and the cylinder chamber 28 can vary as desired.

Figure 1C:
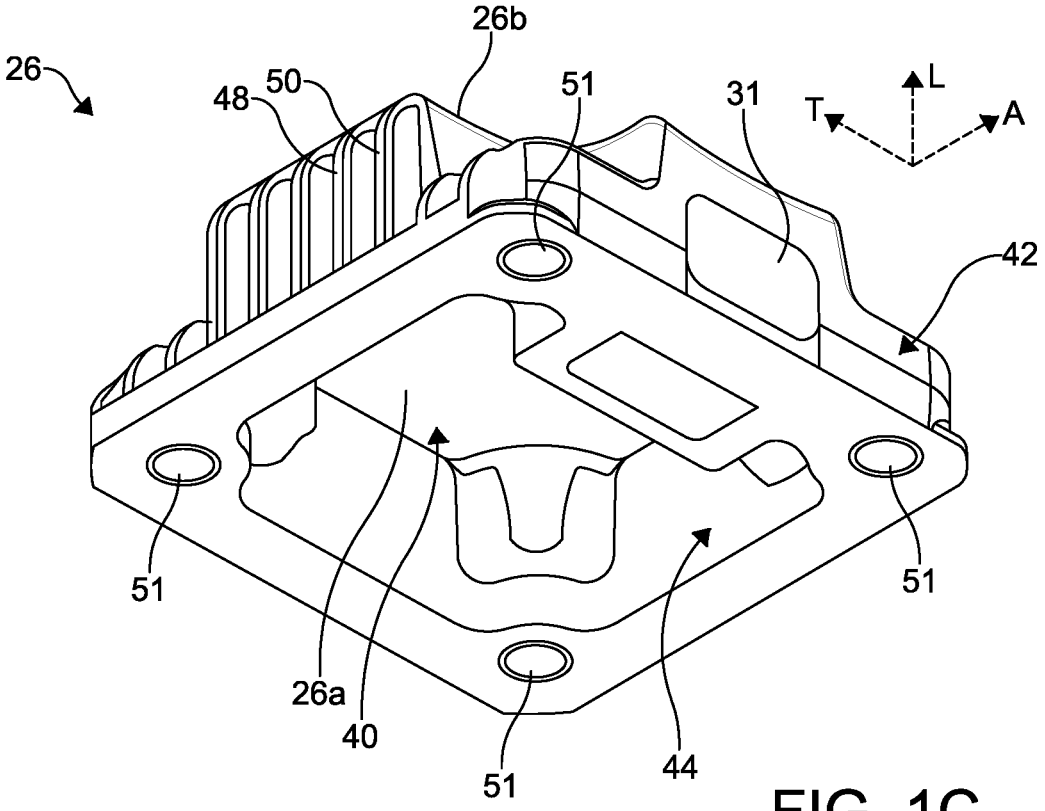
FIG. 1C is a perspective view of a cylinder head of the compressor illustrated in FIG. 1A constructed in accordance with another alternative embodiment.

At least one or both of the inlet 30 and the outlet 32 can be defined by the cylinder head 26. For instance, as illustrated in FIGS. 1A-1B, the cylinder head 26 can define both the inlet 30 and the outlet 32. In particular, the inlet 30 can extend through the cylinder head 26. The inlet 30 can extend through the closure member 40 or through the side wall 42. Similarly, the outlet 32 can extend through the cylinder head 26. For instance, as illustrated in FIGS. 4A-8B, the cylinder head 26 can define an opening 70 that extends therethrough from the inner head surface 26*a* to the outer head surface 26*b*. The opening 70 can define the inlet 30 or the outlet 32. The other of the inlet 30 and the outlet 32 can extend through the inner and outer head surfaces 26*a* and 26*b*, or can alternatively extend through the side wall 42. In particular, the outlet 32 can extend through the closure member 40 or through the side wall 42. The cylinder head 26 can define a divider wall in the interior space 44 that separates the inlet 30 from the outlet 32, as desired. Alternatively, the cylinder head 26 can define a first opening 31 as illustrated in FIG. 1C. The body 22 can define a second opening. The first opening 31 can define the inlet 30 and the second opening can define the outlet 32. Alternatively, the first opening 31 can define the outlet 32 and the second opening can define the inlet 30. The second opening can extend through the outer wall 24 at a location between the piston 34 and the cylinder head 26 during an entirety of the intake and discharge strokes of the piston 34. Thus, both the first and second openings are in fluid communication with the cylinder chamber 28 when the respective intake and discharge valves are open. The first opening 31 can extend through the cylinder head 26 in the manner described above.

It is recognized that the cylinder head 26 can experience cyclical loading during operation, due at least in part to the high negative pressures and positive pressures in the cylinder chamber 28 during use. It is desirable for the cylinder head 26 to be constructed with high stiffness in order to avoid potential negative effects of the cyclical loading.

Referring now to FIGS. 2A-2D, in one example, the cylinder head 26 can define a concavity 46 at the outer head surface 26*b*. In particular, the outer head surface 26*b*, at the concavity 46, can be concave as it extends along at least one direction. Thus, from a view to the outer head surface 26*b* in a direction defined from the second end 22*d* toward the first end 22*c*, the outer head surface 26*b* can be concave at the concavity 46. Accordingly, a plane that is normal to the longitudinal direction L can intersect the outer head surface 26*b* at the concavity 46, such that a first portion of the outer head surface 26*b* lies on one side of the plane, and a second portion of the outer head surface 26*b* lies on an opposite side of the plane. The at least one direction can be perpendicular to the longitudinal direction L. For instance, it can be defined by the transverse direction T. Alternatively, the at least one direction can be defined by a lateral direction A that is perpendicular to each of the transverse direction T and the longitudinal direction L. Alternatively still, the at least one direction can be angularly offset to each of the lateral direction A and the transverse direction A. The concavity 46 can have a length along the at least one direction that is perpendicular to the longitudinal direction L. The length can be at least half of an outer dimension of the cylinder head 26 defined by opposed locations of the side wall 42 along a direction parallel to the length that intersects a central head axis 57. For instance, the length can be between half and an entirety of the dimension of the cylinder head 26 defined by opposed locations of the side wall 42 along a direction that intersects the central head axis 57. In one example, the length can be an entirety of the dimension of the cylinder head 26 defined by opposed locations of the side wall 42 along a direction that intersects the central head axis 57. The concavity 46 can have a width that is perpendicular to both the length and the longitudinal direction L. The width can be at least half of an outer dimension of the cylinder head 26 defined by opposed locations of the side wall 42 along a direction parallel to the width that intersects a central head axis 57. For instance, the width can be between half and an entirety of the dimension of the cylinder head 26 defined by opposed locations of the side wall 42 along the direction parallel to the width that intersects the central head axis 57. In one example, the width can be an entirety of the dimension of the cylinder head 26 defined by opposed locations of the side wall 42 along the direction parallel to the width that intersects the central head axis 57. The central head axis 57 can be oriented along the longitudinal direction L, and can be coincident with a central axis 25 of the cylinder chamber 28.

In one example, the concavity 46 can be substantially U-shaped along a plane that extends through the concavity 46 along the longitudinal direction L and the at least one direction. Thus, the concavity 46 can be straight and linear along a second direction that is perpendicular to the at least one direction. Accordingly, the concavity 46 can be said to define a shape of an inverted parabola. It has been found that the concavity 46 provides high stiffness to the cylinder head 26 against internal pressure in the cylinder chamber 28. In one example, the concavity 46 can define a lowest point that is aligned with the central axis 25 of the cylinder chamber 28 and oriented along the longitudinal direction L. Otherwise stated, the concavity 46 can be centered about the central head axis 57 and the central axis 25 of the cylinder chamber 28 that each extends along the longitudinal direction L. Thus, the concavity 46 can be symmetrical about the central axis 25. The inner head surface 26*a* can be substantially flat or otherwise shaped in such a manner so as to not match or otherwise be defined by the concavity 46. The inner head surface 26*a* can alternatively define a convexity that matches the concavity 46 and is complementary to the concavity 46.

Figure 3:
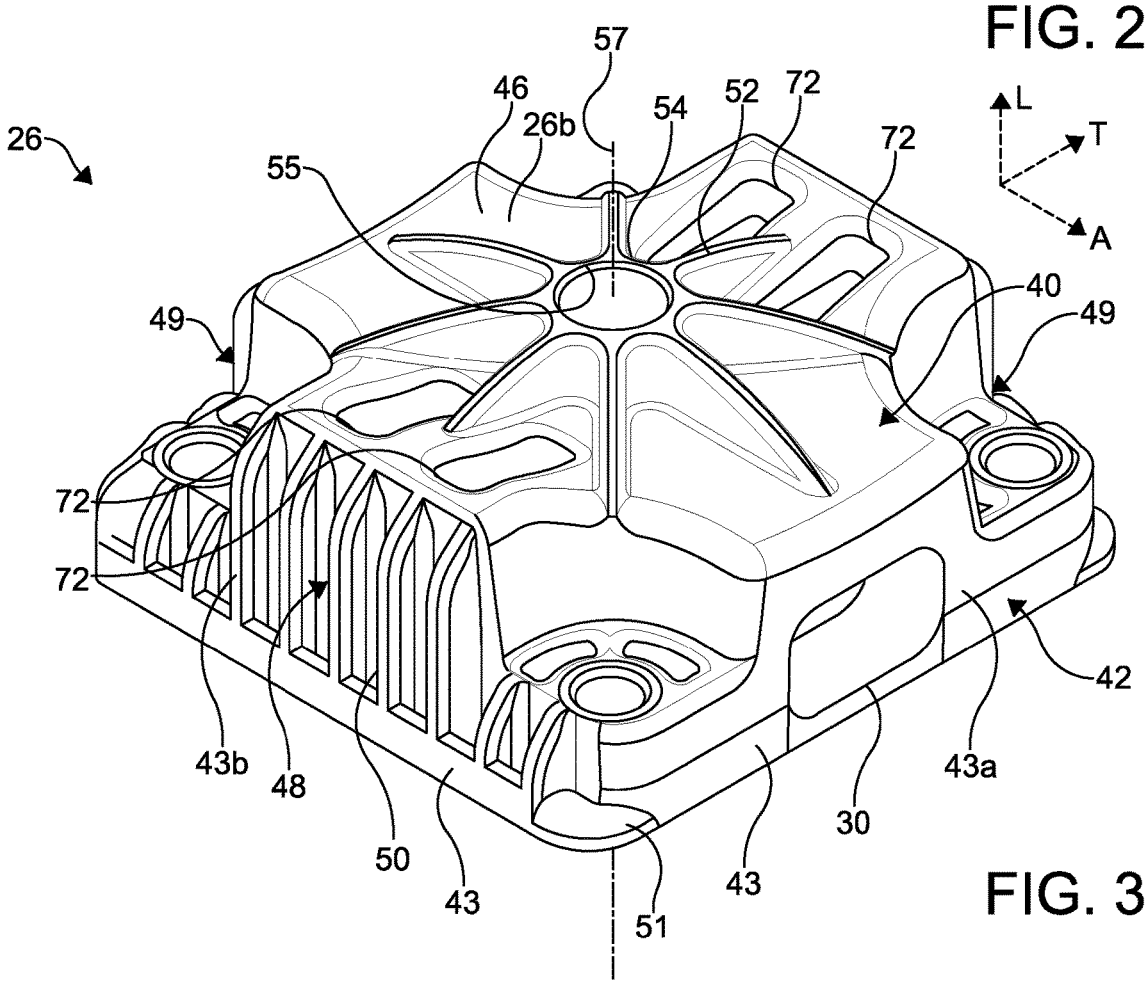
FIG. 3 is a perspective view of a cylinder head of the compressor illustrated in FIG. 1A, but constructed in accordance with an alternative embodiment.
Figure 4A:
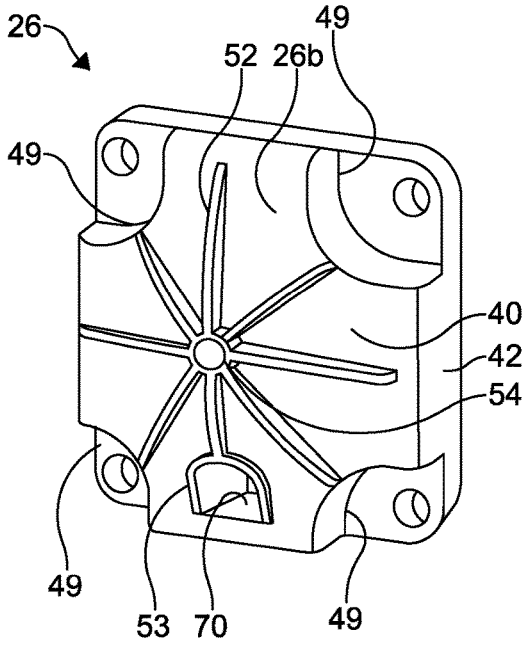
FIG. 4A is a perspective view of a cylinder head of the compressor illustrated in FIG. 1A, constructed in accordance with an alternative embodiment.
Figure 4B:
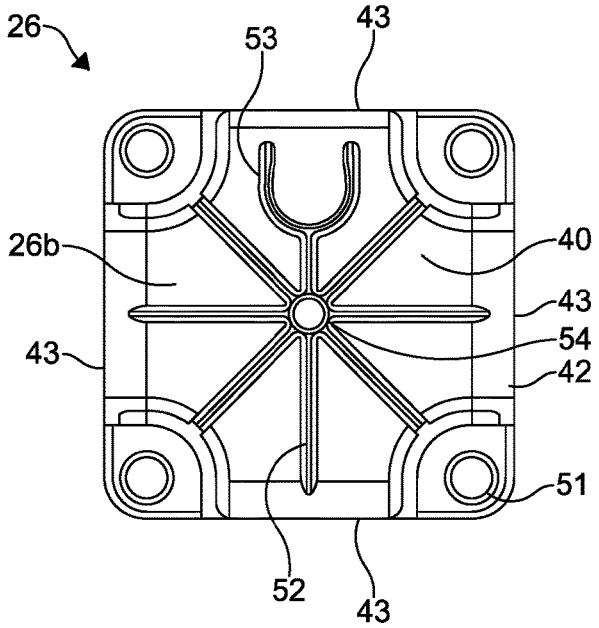
FIG. 4B is a top plan view of the cylinder head illustrated in FIG. 4A.

Alternatively, as illustrated in FIG. 3, the outer head surface 26*b*, at the concavity 46, can be concave as it extends along both a first direction that is perpendicular to the longitudinal direction L and a second direction that is perpendicular to the longitudinal direction L. The second direction is angularly offset with respect to the first direction. For instance, the second direction can be perpendicular with respect to the first direction. The first direction can be perpendicular to a first opposed pair of the sides 43. Similarly, the second direction can be perpendicular to a second opposed pair of the sides 43 that is different than the first pair. In one example, the concavity 46 can be dish shaped. Thus, the concavity 46 can define a round outer perimeter in a plane that is normal to the longitudinal direction L through the concavity 46. For instance, the round shape can be circular. Alternatively the round shape can be elliptical. Alternatively still, the round shape can be irregularly shaped. Alternatively still, the outer perimeter of the concavity in the plane can define any suitable geometry as desired, such as a polygonal geometry. The polygonal geometry can be regular or irregular as desired.

Referring to FIGS. 2A-2E, each of the sides 43 of the side wall 42 can define an inner side surface 43*a* that faces the interior space 44, and an outer side surface 43*b* that is opposite the inner side surface 43*a*. In one example, at least a portion of the outer side surfaces 43*b* can be substantially smooth. Substantially smooth is intended to encompass a surface geometry that does not include structure that enhances the stiffness of the cylinder head 26. In one example, the inlet 30 and the outlet 32 extend through opposed sides 43 that have substantially smooth outer side surfaces 43*b*. The remaining sides 43, other than the sides 43 that define the inlet 30 and outlet 32, can define a plurality of slots 48 that extend into the respective outer side surface 43*b* so as to define a corresponding plurality of projections 50 that are separated by respective ones of the slots 48 along an outer perimeter of the side wall 42. The slots 48 and projections 50 can be arranged between adjacent ones of the mounting apertures 51. The projections 50 and slots 48 can be alternatingly arranged along a plane that is oriented normal to the longitudinal direction L and intersects the side wall 42, and in particular the sides 43. In one example, the projections 50 can be equidistantly spaced about the perimeter of the side wall 42 at the sides 43 that include the projections 50. Alternatively, the projections 50 can be spaced from each other at any interval, wither equidistant or variable, as desired. The projections 50 can define stiffeners that enhance the stiffness of the cylinder head 26 during operation of the compressor 20. It has been found that the projections 50 increase the bending stiffness of the cylinder head 26. As will be described in more detail below, the cylinder head 26 can be an injection molded polymer. Thus, the side wall 42 can be monolithic with the inner head surface 26*a* and the outer head surface 26*b*. In one embodiment illustrated in FIG. 6C, the projections 50 can be arranged along all of the sides 43.

Figure 5A:
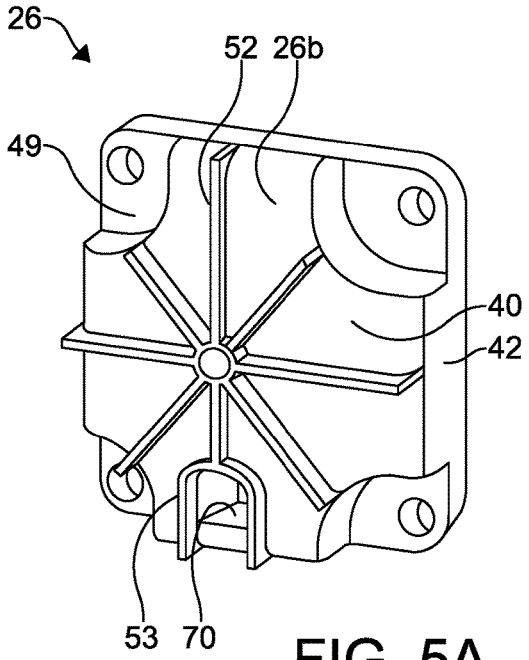
FIG. 5A is a perspective view of a cylinder head of the compressor illustrated in FIG. 1A, constructed in accordance with an alternative embodiment.
Figure 5B:
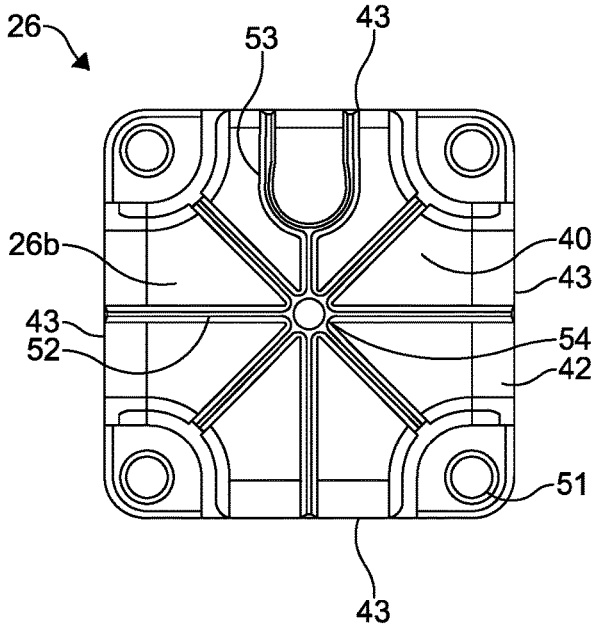
FIG. 5B is a top plan view of the cylinder head illustrated in FIG. 5A.

The cylinder head 26 can further include a plurality of stiffening ribs 52 that project out from the outer head surface 26*b* in a direction defined from the first end 22*c* to the second end 22*d*. The ribs 52 can be oriented in any direction as desired, and in one example, are planar along respective planes that include the longitudinal direction L. The ribs 52 can extend radially outward from a common hub 54. The common hub 54 can be defined by a common location to which the ribs 52 extend. The common hub 54 can be an empty space. Alternatively, the common hub 54 can define an intersection of the ribs 52. Alternatively still, the common hub 54 can define a central wall 55. The central wall 55 can define a closed shape along a plane that is normal to the longitudinal direction L and extends through the central wall 55. In one example, the hub 54 can be cylindrical about a central axis that is oriented along the longitudinal direction L. The central axis of the hub 54 can be coincident with the central axis of the cylinder chamber 28. The ribs 52 can be equidistantly circumferentially spaced from each other about the hub 54. Alternatively, the ribs 52 can be variably spaced from each other about the hub 54. The ribs 52 can define a height from the outer head surface 26*b*. The height can taper toward the outer head surface 26*b* as the rib extends in the radially outward direction away from the hub 54. For instance, the ribs 52 can terminate without overhanging the outer perimeter of the outer head surface 26*b*. It has been found that the ribs 52 can provide uniformly high stiffness for the cylinder head 26 against internal pressure in the cylinder chamber 28. Alternatively, as illustrated in FIGS. 5A-5B, the height of the ribs 52 can be substantially constant from the hub 54 to the outer ends of the ribs 52 opposite the hub 54. Further, the outer ends of at least one or more of the ribs 52 up to all of the ribs 52 can be coplanar with a respective one of the outer side surfaces 43*b*.

As illustrated in FIGS. 4A-7A, the cylinder head 26 can further include an auxiliary stiffening rib 53 that extends out from the outer head surface 26*b*. The auxiliary stiffening rib 53 can at least partially surround the opening 70. For instance, the auxiliary stiffening rib 53 can have a round shape in a plane that is oriented normal to the longitudinal axis L that extends through the auxiliary stiffening rib 53. The auxiliary stiffening rib 53 can be attached to one of the stiffening ribs 52.

Figure 2A:
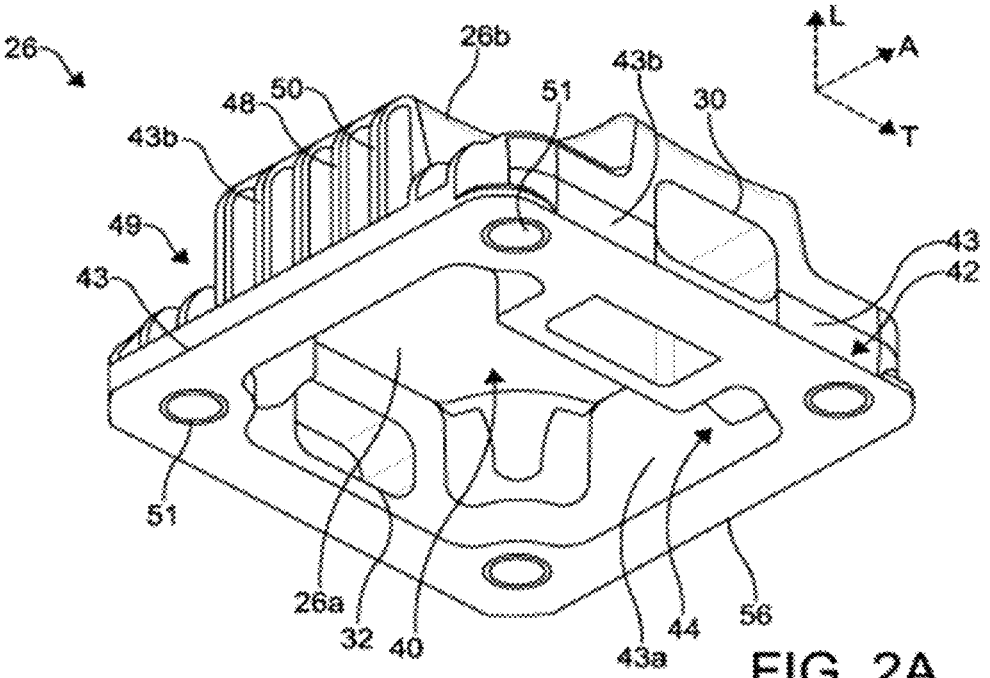
FIG. 2A is a perspective view of the cylinder head of the compressor illustrated in FIG. 1A, constructed in accordance with one embodiment.
Figure 2B:
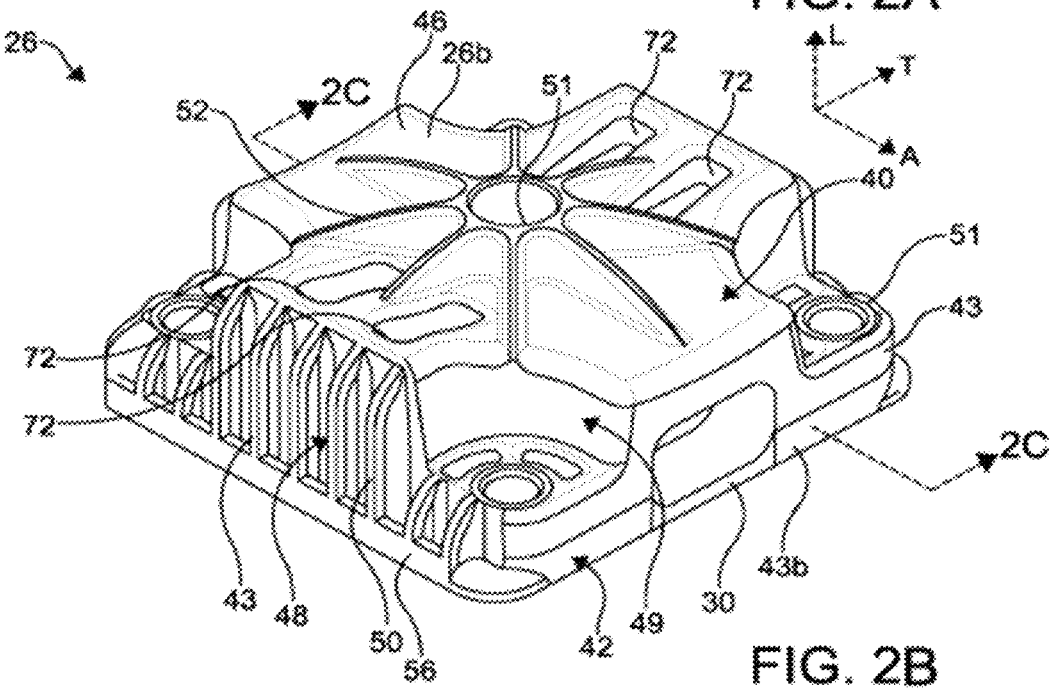
FIG. 2B is another perspective view of the cylinder head illustrated in FIG. 2A.
Figure 2C:
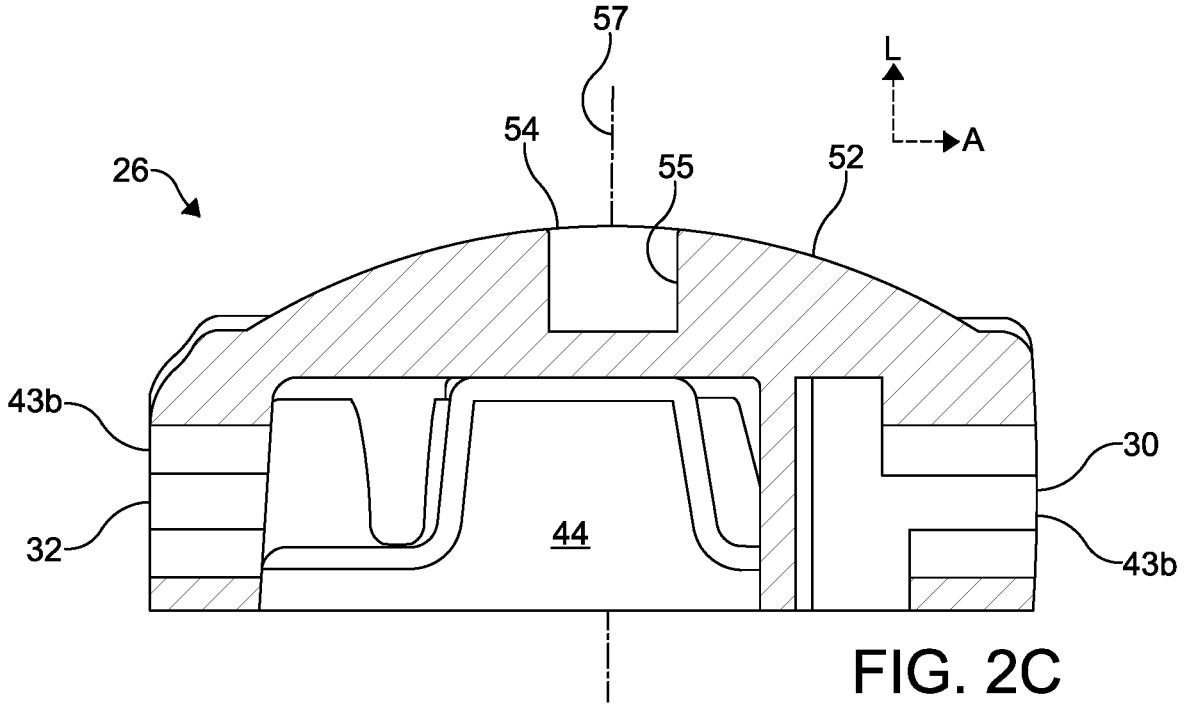
FIG. 2C is a sectional side elevation view of the reciprocating compressor illustrated in FIG. 2B, taken along line 2C-2C.
Figure 2D:
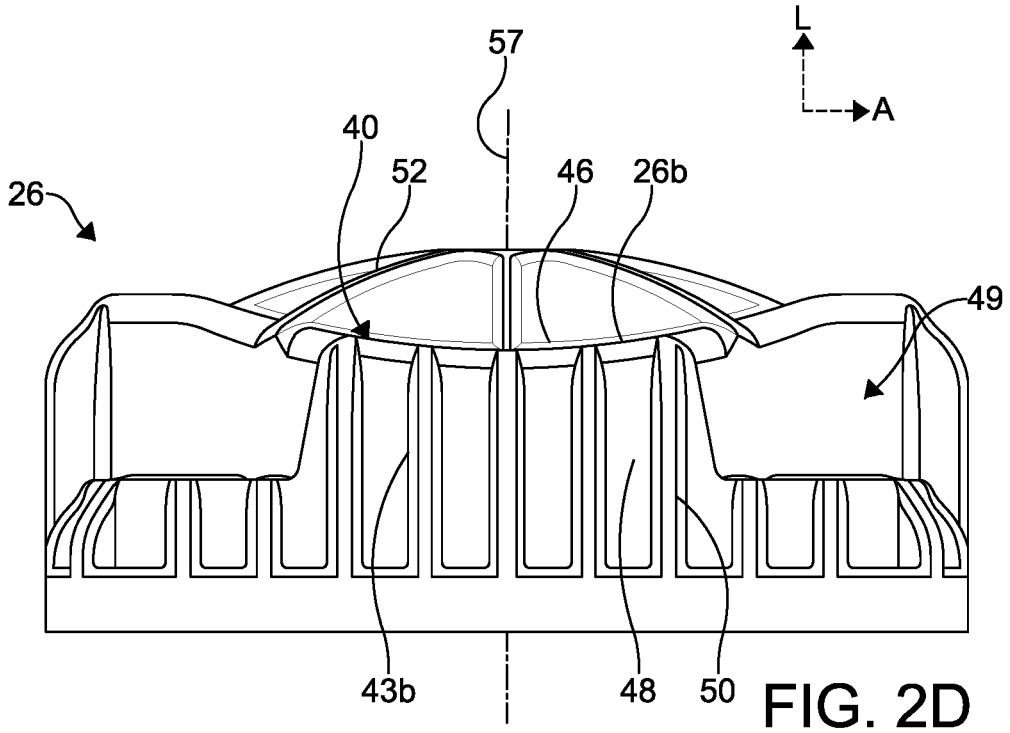
FIG. 2D is a side elevation view of the cylinder head illustrated in FIG. 2A.
Figure 2E:
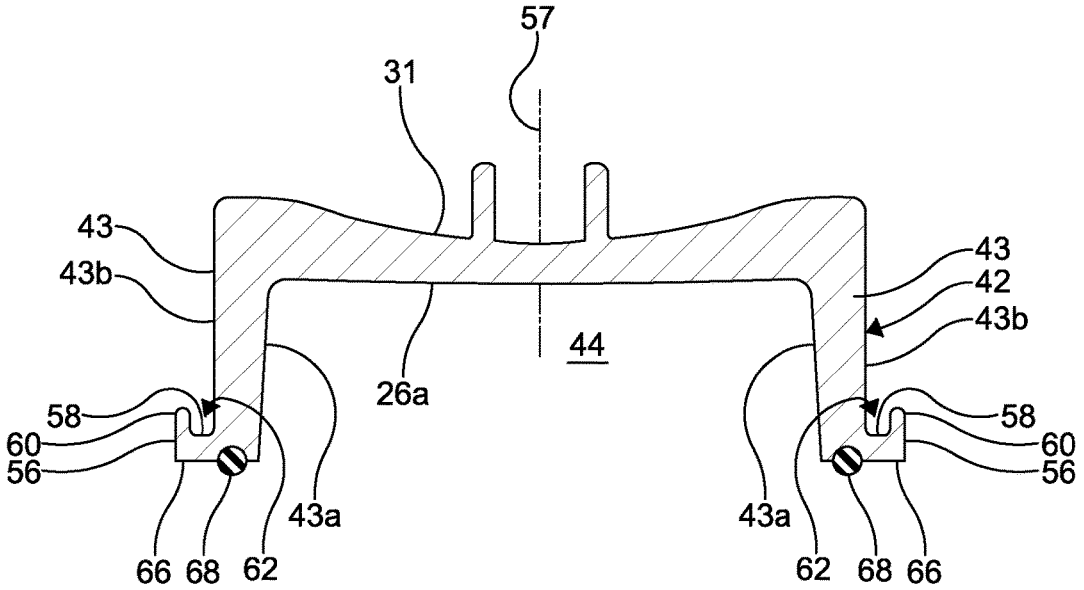
FIG. 2E is a side elevation view of the cylinder head illustrated in FIG. 2B, taken along line 2E-2E, and shown with ribs removed for the purposes of illustration.

Referring now to FIG. 2E, a cross-section of the cylinder head 26 is shown with the ribs 52 removed for the purposes of clarity. The cylinder head 26 can include at least one flange 56 that projects out from an outer perimeter of the side wall 42. In particular, the at least one flange 56 can project out from one or more up to all of the outer side surfaces 43*b*. The at least one flange 56 can include a shoulder 58 that extends out from the outer perimeter of the side wall 42 away from the central head axis 57 of the cylinder head that is oriented along the longitudinal direction L. The flange 56 further includes a lip 60 that extends out from the shoulder 58 along the longitudinal direction L. For instance, the lip 60 can extend out from the shoulder 58 in a direction that is defined from the first end 22*c* to the second end 22*d*. The lip 60 can be positioned so as to be spaced from the side wall 42 such that an air gap 62 is defined between the side wall 42 and the lip 60. It has been found that the projections 50 described above can prevent the flanges 56 from opening up (e.g., increasing the distance of the air gap 62) under assembly as well as during operating loads created by the internal pressure in the cylinder chamber 28.

With continuing reference to FIG. 2E, the cylinder head 26, and in particular the side wall 42, can defines an inner surface 66 configured to interface with the cylinder body 22 when the cylinder head 26 is attached to the cylinder body 22. The compressor 20 further includes a compressible gasket 68 disposed at the inner surface 66. For instance, the gasket 68 can be overmolded by the cylinder head 26. The gasket 68 can compress against the cylinder body 22 so as to define a seal at the interface between the cylinder body and the inner surface 66. In one example, the gasket 68 can be elastomeric. The gasket 68 can have any suitable cross-section as desired, such as circular or polygonal (in one example, rectangular).

Figure 6A:
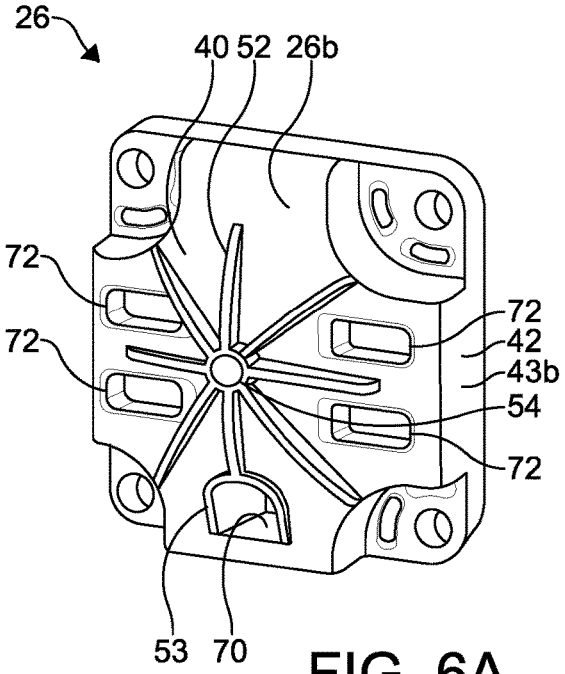
FIG. 6A is a perspective view of a cylinder head of the compressor illustrated in FIG. 1A, constructed in accordance with an alternative embodiment.
Figure 6B:
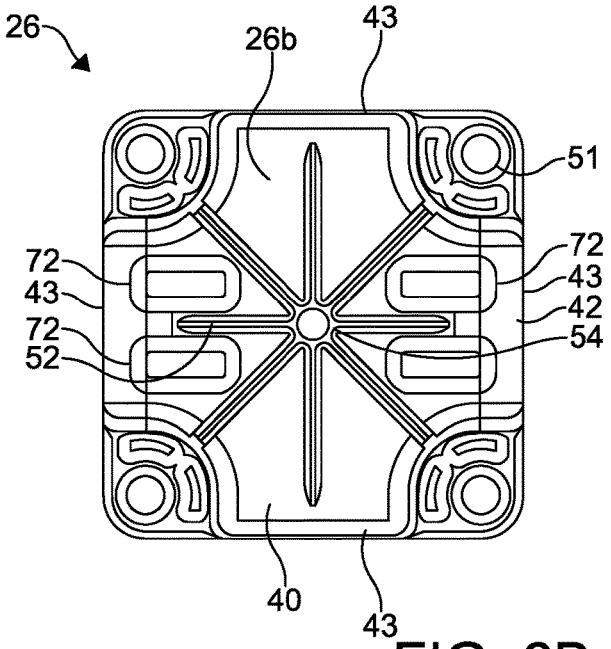
FIG. 6B is a top plan view of a cylinder head similar to the cylinder head illustrated in FIG. 6A.
Figure 6C:
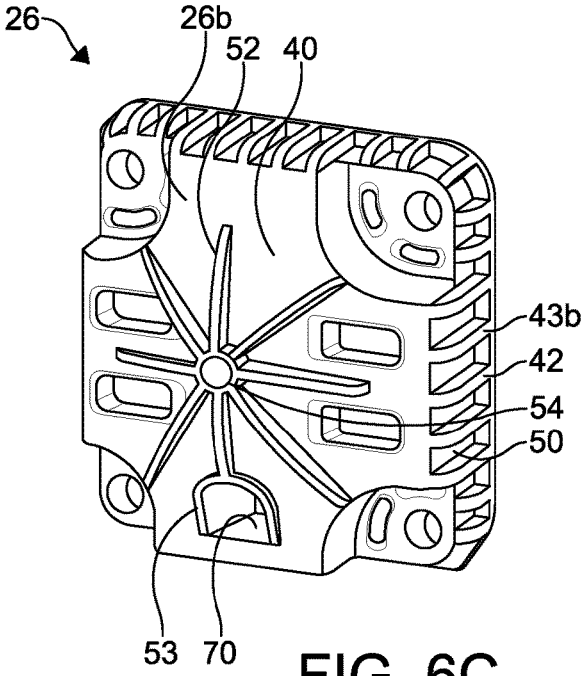
FIG. 6C is a perspective view of the cylinder head illustrated in FIG. 6A, but including side stiffeners in accordance with one embodiment.

Referring now to FIGS. 6A-6C, the cylinder head 26 can define at least one pocket 72 that extends into the outer head surface 26*b*. The at least one pocket 72 can terminate in the cylinder head 26 without extending through the inner head surface 26*a*. The at least one pocket 72 is disposed between adjacent ones of the ribs 52. For instance, the at least one pocket 72 can include a plurality of pockets 72 that each extend into the cylinder head 26 between different adjacent ones of the ribs 52. The pockets 72 can be elongate along a select direction that is perpendicular to the longitudinal direction L, and respective pairs of the pockets 72 can be aligned with each other along the select direction. A first portion of the pockets 72 can be circumferentially aligned with the ribs 52, and a second portion of the pockets 72 can extend radially outward with respect to the outer ends of the ribs 52.

Figure 7A:
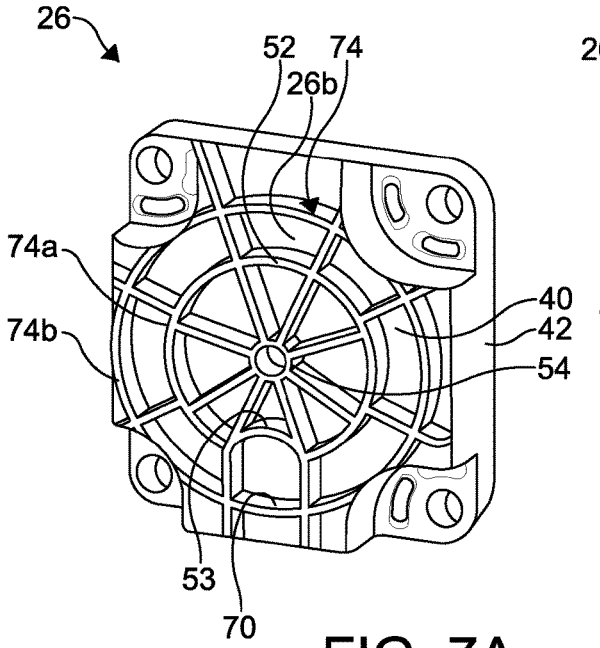
FIG. 7A is a perspective view of a cylinder head of the compressor illustrated in FIG. 1A, constructed in accordance with an alternative embodiment.
Figure 7B:
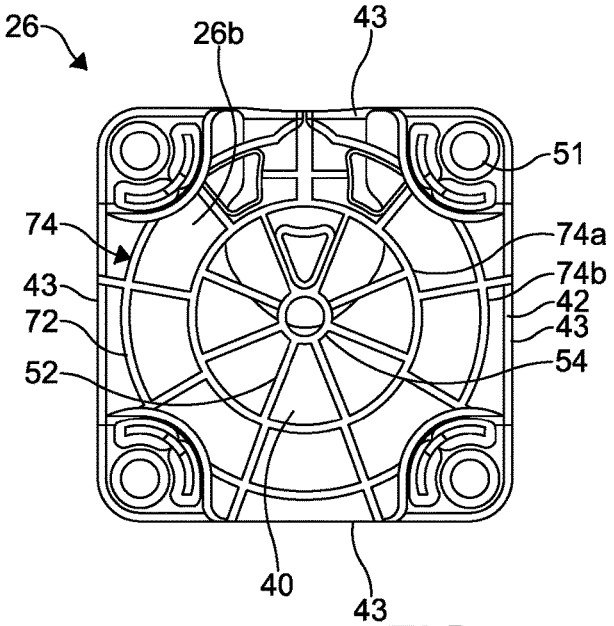
FIG. 7B is a top plan view of a cylinder head similar to the cylinder head illustrated in FIG. 7A.

Referring now to FIGS. 7A-7B, the cylinder head 26 can further include at least one circumferential rib 74 that extends out from the outer head surface 26*b*. In one example, the cylinder head can include a pair of circumferential ribs 74, including an inner rib 74*a* and an outer rib 74*b*. The inner rib 74*a* can be disposed between the hub 54 and the outer rib 74*b*. The circumferential ribs 74 can extend circumferentially about the hub 54, and can intersect at least one up to all of the ribs 52, which can define a first plurality of ribs. The circumferential ribs 74 can further enhance the stiffness of the cylinder head 26 against internal pressure in the cylinder chamber 28. The ribs 52 can each include a first portion that extends from the hub 54 to the inner rib 74*a*, and a second portion that extends from the inner rib 74*a* to the outer rib 74*b*. The first portion of each of the ribs 52 can be inline with the second portion, or can be circumferentially offset from the second portion as desired.

Figure 8A:
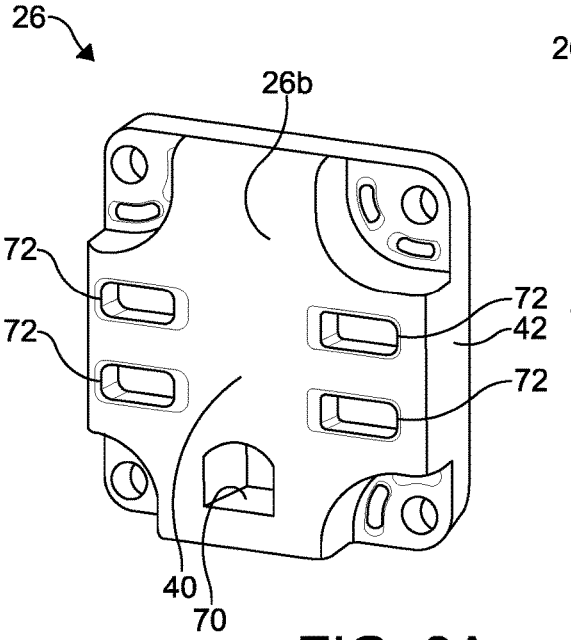
FIG. 8A is a perspective view of a cylinder head of the compressor illustrated in FIG. 1A, constructed in accordance with an alternative embodiment.
Figure 8B:
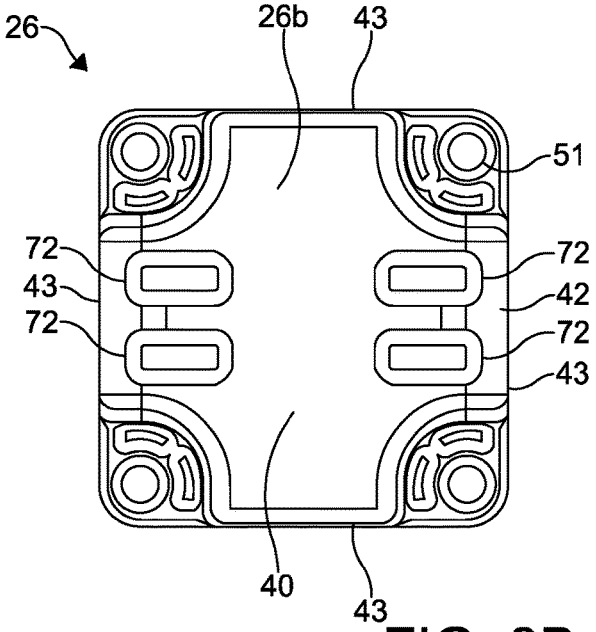
FIG. 8B is a top plan view of a cylinder head similar to the cylinder head illustrated in FIG. 8A.

Alternatively, as illustrated in FIGS. 8A-8B, the cylinder head 26 can be devoid of the ribs 52, 53, and 74. Further, the cylinder head 26 can be devoid of the projections 50 and slots 48. Thus, both the outer head surface 26*b* of the cylinder head 26 and the outer side surfaces 43*b* can be substantially smooth, thereby reducing the weight of the cylinder head 26 and further increasing manufacturing efficiency. It should be appreciated that the pockets 72 illustrated in FIGS. 8A-8B can be constructed as described above, but they are not positioned between adjacent ones of ribs 52.

It should be appreciated that the cylinder head 26 as described above with respect to FIGS. 1-8B can include the concavity 46 described above. It should be further appreciated that while the polymeric cylinder head 26 can be used in the reciprocating compressor 20 as described above, the polymeric cylinder head 26 can also be used in other types of compressors as desired, such as scroll compressors.

The cylinder head 26 can be made of any suitable polymer. In one example, the polymer is infused with glass particles that are embedded therein. Accordingly, in one example the cylinder head 26 can be injection molded. Thus, the cylinder head 26, including the closure member 40, the side wall 42, the projections 50 (if present), the ribs (if present, including the ribs 52, the ribs 53, and the ribs 74), and the flange 56 (if present), can all be one single unitary monolithic homogeneous component. It has been found that the polymeric cylinder head 26 allows for the gasket 68 to be overmolded as described above. Further, the polymeric cylinder head 26 can avoid corrosion and to further provide thermal insulation with respect to the gaseous fluid that travels through the compressor 20 at high temperatures. Additionally, polymeric cylinder head 26 can have a reduced weight and reduced manufacturing complexity with respect to conventional metallic cylinder heads. The reduced weight can increase the efficiency of the cylinder head 26 with respect to conventional metallic cylinder heads. The polymer can be configured as an ULTEM™ polymer, commercially available from Saudi Arabia Basic Industries Corporation (SABIC), having a principal place of business in Riyadh, Saudi Arabia. An ULTEM™ polymer is a polymer from the family of polyetherimides (PEI). ULTEM™ polymers can have elevated thermal resistance, high strength and stiffness, and broad chemical resistance. As described above, the cylinder head 26 made from ULTEM™ polymer can include glass particles embedded into the ULTEM™ polymer.

It should be appreciated that the present disclosure can include any one up to all of the following examples:

Example 1

A compressor comprising:

a cylinder body defining an outer wall having an inner body surface and an outer body surface opposite the inner body surface, wherein the inner body surface partially defines a cylinder chamber, and the cylinder body defines a first end and an open second end opposite the first end;

a cylinder head supported by the cylinder body at the second end, the cylinder head defining an inner head surface that faces the cylinder chamber, an outer head surface that is opposite the inner head surface along a central head axis, and a side wall configured to attach to the cylinder body, wherein the outer head surface defines a concavity along at least one direction; and a piston supported in the cylinder chamber and movable along a longitudinal direction along an intake stroke that creates negative pressure in the cylinder chamber so as to draw fluid into the cylinder chamber through an inlet, and a discharge that creates positive pressure in the cylinder chamber so as to force fluid out of the cylinder chamber through an outlet, wherein at least one of the inlet and the outlet is defined by the cylinder head, wherein the concavity has a length along a direction perpendicular to the longitudinal direction, and the length is at least half of an outer dimension of the cylinder head defined by opposed locations of the side wall along a direction that intersects the central head axis.

Example 2

The compressor as recited in example 1, wherein the at least one direction comprises a first direction that is perpendicular to the longitudinal direction Example 3

The compressor as recited in any one of the preceding examples, wherein the concavity is straight and linear along a second direction that is perpendicular to both the first direction and the longitudinal direction.

Example 4

The compressor as recited in example 2, wherein the at least one direction comprises a second direction that is perpendicular to the longitudinal direction and angularly offset with respect to the first direction.

Example 5

The compressor as recited in example 4, wherein the second direction is perpendicular to the longitudinal direction.

Example 6

The compressor as recited in any one of examples 4 to 5, wherein the concavity defines a round perimeter in a plane that is normal to the longitudinal direction.

Example 7

The compressor as recited in example 6, wherein the round perimeter is circular.

Example 8

The compressor as recited in any one of examples 4 to 7, wherein the concavity is substantially dish shaped.

Example 9

The compressor as recited in any one of the preceding examples, wherein the concavity is centered about a central axis of the cylinder chamber that extends along the longitudinal direction.

Example 10

The compressor as recited in any one of the preceding examples, wherein the piston is supported by a shaft in the cylinder chamber, such that rotation of the shaft causes the piston to move between the intake stroke and the discharge stroke.

Example 11

The compressor as recited in any one of the preceding examples, wherein the inner head surface is aligned with the cylinder chamber along the longitudinal direction Example 12

The compressor as recited in any one of the preceding examples, wherein the outer head surface is aligned with the cylinder chamber along the longitudinal direction Example 13

The compressor as recited in any one of the preceding examples, wherein the first end is closed.

Example 14

The compressor as recited in example 13, wherein the cylinder body comprises a base that closes the first end.

Example 15

The compressor as recited in example 14, wherein the base is monolithic and homogeneous with the outer wall of the cylinder body.

Example 16

The compressor as recited in any one of the preceding examples, wherein the cylinder head is separate from the cylinder body and configured to be attached to the cylinder body at the second end.

Example 17

The compressor as recited in any one of the preceding examples, wherein both the inlet and outlet are defined by the cylinder head, and the cylinder head comprises a divider wall that separates the inlet from the outlet.

Example 18

The compressor as recited in any one of examples 1 to 16, wherein the inlet extends through the outer wall of the cylinder body, and the outlet is defined by the cylinder head.

Example 19

The compressor as recited in any one of examples 1 to 16, wherein the inlet is defined by the cylinder head, and the outer wall extends through the cylinder body.

Example 20

The compressor as recited in any one of the preceding examples, wherein the cylinder head comprises a polymer.

Example 21

The compressor as recited in example 20, wherein the polymer further comprises glass particles embedded therein.

Example 22

The compressor as recited in any one of examples 20 to 21, wherein the polymer comprises a polyetherimide.

Example 23

The compressor as recited in any one of the preceding examples, wherein the cylinder head is injection molded.

Example 24

The compressor as recited in any one of the preceding examples, wherein the cylinder head includes a closure member that defines the inner head surface and the outer head surface, and the side wall that extends from the closure member.

Example 25

The compressor as recited in example 24, wherein the side wall extends from the closure member in a direction that is defined from the second end of the cylinder body toward the first end of the cylinder body.

Example 26

The compressor as recited in any one of examples 24 to 25, wherein the cylinder head comprises a flange that projects out from an outer perimeter of the side wall.

Example 27

The compressor as recited in example 26, wherein the flange comprises a shoulder that extends out from the outer perimeter of the side wall away from the central head axis that is oriented along the longitudinal direction, and the flange further comprises a lip that extends out from the shoulder in a direction that is defined from the first end to the second end.

Example 28

The compressor as recited in example 27, wherein the lip is spaced from the side wall such that an air gap is defined between the side wall and the lip.

Example 29

The compressor as recited in any one of examples 24 to 28, wherein the side wall defines an outer side surface that extends from the closure member so as to define an interior space of the cylinder head that defines a portion of the cylinder chamber when the cylinder head is attached to the cylinder body.

Example 30

The compressor as recited in example 29, wherein the outer side surface is substantially smooth.

Example 31

The compressor as recited in example 29, wherein the cylinder head defines a plurality of slots that extend into the outer side surface so as to define projections separated by respective ones of the slots along an outer perimeter of the side wall.

Example 32

The compressor as recited in example 31, wherein the projections and slots are alternatingly arranged along a plane that is oriented normal to the longitudinal direction and intersects the side wall.

Example 33

The compressor as recited in any one of examples 31 to 32, wherein the projections are equidistantly spaced about the perimeter of the side wall.

Example 34

The compressor as recited in any one of examples 24 to 33, wherein the side wall is monolithic and homogenous with inner head surface and outer head surface.

Example 35

The compressor as recited in any one of examples 2 to 34, wherein the shaft is oriented along the first direction.

Example 36

The compressor as recited in example 35, further comprising a connecting rod that is connected between the shaft and the piston.

Example 37

The compressor as recited in any one of the preceding examples, further comprising an intake valve that allows fluid to flow into the cylinder chamber under negative pressure in the cylinder chamber, and prevents fluid from flowing from the cylinder chamber out the inlet under positive pressure in the cylinder chamber.

Example 38

The compressor as recited in any one of the preceding examples, further comprising discharge valve that allows fluid to flow out of the cylinder chamber through the outlet under positive pressure in the cylinder chamber, and prevents fluid from flowing into the cylinder chamber from the outlet under negative pressure in the cylinder chamber.

Example 39

The compressor as recited in any one of the preceding examples, wherein the fluid is a refrigerant of a refrigeration system.

Example 40

The compressor as recited in any one of the preceding examples, wherein the cylinder head defines an inner surface configured to interface with the cylinder body when the cylinder head is attached to the cylinder body, and the compressor further comprises a compressible gasket at the inner surface.

Example 41

The compressor as recited in example 40, wherein the gasket is elastomeric.

Example 42

The compressor as recited in any one of examples 40 to 41, wherein the gasket is overmolded by the cylinder head.

Example 43

The compressor as recited in any one of the preceding examples, wherein the cylinder head comprises a plurality of stiffening ribs that project out from the outer head surface.

Example 44

The compressor as recited in example 43, wherein the ribs extend radially outward from a common hub.

Example 45

The compressor as recited in example 44, wherein the common hub defines a central wall.

Example 46

The compressor as recited in example 45, wherein the common hub is cylindrical about a respective central axis that is oriented in the longitudinal direction.

Example 47

The compressor as recited in example 46, wherein the central axis of the common hub is coincident with the central head axis.

Example 48

The compressor as recited in any one of examples 44 to 47, wherein the ribs are equidistantly circumferentially spaced from each other about the common hub.

Example 49

The compressor as recited in any one examples 44 to 48, wherein the ribs define a height from the outer head surface, and the height tapers toward the outer head surface in a direction away from the common hub.

Example 50

The compressor as recited in any one of examples 43 to 49, wherein the ribs terminate without overhanging an outer perimeter of the outer head surface.

Example 51

The compressor as recited in any one of examples 43 to 50, wherein the ribs are planar along respective planes that include the longitudinal direction L.

Example 52

The compressor as recited in any one of examples 43 to 51, wherein the ribs comprise a first plurality of ribs, and the compressor further comprises at least one circumferential rib that intersects at least one of the first plurality of ribs.

Example 53

The compressor as recited in example 52, wherein the at least one circumferential rib intersects each of the first plurality of ribs.

Example 54

The compressor as recited in any one of examples 52 to 53, wherein the first plurality of ribs extend radially outward from a common hub, the at least one circumferential rib includes an outer circumferential rib and an inner circumferential rib disposed between the common hub and the outer circumferential rib.

Example 55

The compressor as recited in example 54, wherein the inner and outer circumferential ribs are concentric about the common hub.

Example 56

The compressor as recited in any one of examples 43 to 51, wherein the cylinder head defines at least one pocket that extends into the outer head surface.

Example 57

The compressor as recited in example 56, wherein the at least one pocket terminates in the cylinder head without extending through the inner head surface.

Example 58

The compressor as recited in any one of examples 56 to 57, wherein the at least one pocket is disposed between adjacent ones of the ribs.

Example 59

The compressor as recite in example 58, wherein the at least one pocket comprises plurality of pockets that extend into the outer head surface at respective locations between different pairs of adjacent ones of the ribs.

Example 60

The compressor as recited in any one of examples 1 to 42, wherein the cylinder head comprises at least one circumferential rib that extends out from the outer head surface.

Example 61

The compressor as recited in example 60, wherein the at least one circumferential rib includes an outer circumferential rib and an inner circumferential rib concentrically arranged with the outer circumferential rib.

Example 62

The compressor as recited in any one of examples 1 to 42, wherein the outer head surface is substantially smooth.

Example 63

The compressor as recited in example 62, wherein the cylinder head defines at least one pocket that extends into the outer head surface.

Example 64

The compressor as recited in example 63, wherein the at least one pocket terminates in the cylinder head without extending through the inner head surface.

Example 65

The compressor as recited in any one of examples 63 to 64, wherein the at least one pocket includes a pair of pockets elongate along a select direction perpendicular to the longitudinal direction, and the pockets of the pair of pockets are aligned with each other along the select direction.

Example 66

The compressor as recited in any one of the preceding examples, wherein the length of the concavity is greater than three-quarters of the dimension of the outer dimension of the cylinder head.

Example 67

The compressor as recited in any one of the preceding examples, wherein the length of the concavity is substantially equal to the outer dimension of the cylinder head.

Example 68

The compressor as recited in any one examples 1, 66 to 67, wherein the central head axis is oriented along the longitudinal direction.

Example 69

A refrigeration system comprising:

the compressor as recited in any one of examples 1 to 68;

a condenser that receives the fluid output from the compressor that removes heat from the fluid, causing the fluid to enter a liquid phase;

an expansion valve that decreases a pressure of the fluid; and an evaporator whereby the fluid removes heat from a space to be cooled, thereby causing the fluid to enter a gaseous phase, wherein the compressor is configured to draw the gaseous phase fluid is into the inlet of the compressor from the evaporator.

Example 70

A cylinder head configured to be mounted onto a compressor body of the type that contains a compressor chamber, the cylinder head comprising:

an inner head surface that is configured to face the cylinder chamber;

an outer head surface that is opposite the inner head surface along a longitudinal direction, wherein the cylinder head defines a central axis that extends centrally through the inner head surface and the outer head surface along the longitudinal direction; and a side wall that is configured to attach to the compressor body, wherein the cylinder head defines at least one of a fluid inlet and a fluid outlet, and the outer head surface defines a concavity along at least one direction; and concavity has a length along a direction perpendicular to the longitudinal direction, and the length is at least half of a dimension of the cylinder head defined by opposed locations of the side wall along a direction that intersects the central head axis.

Example 71

The cylinder head as recited in example 70, wherein the at least one direction comprises a first direction that is perpendicular to the longitudinal direction Example 72

The cylinder head as recited in any one of examples 70 to 71, wherein the concavity is straight and linear along a second direction that is perpendicular to both the first direction and the longitudinal direction.

Example 73

The cylinder head as recited in example 71, wherein the at least one direction comprises a second direction that is perpendicular to the longitudinal direction and angularly offset with respect to the first direction.

Example 74

The cylinder head as recited in example 73, wherein the second direction is perpendicular to the longitudinal direction.

Example 75

The cylinder head as recited in any one of examples 73 to 74, wherein the concavity defines a round perimeter in a plane that is normal to the longitudinal direction.

Example 76

The cylinder head as recited in example 75, wherein the round perimeter is circular.

Example 77

The cylinder head as recited in any one of examples 73 to 76, wherein the concavity is substantially dish shaped.

Example 78

The cylinder head as recited in any one of examples 70 to 77, wherein the concavity is centered about a central head axis.

Example 79

The cylinder head as recited in any one of examples 70 to 78, wherein the cylinder head comprises a polymer.

Example 80

The cylinder head as recited in example 79, wherein the polymer further comprises glass particles embedded therein.

Example 81

The cylinder head as recited in any one of examples 79 to 80, wherein the polymer comprises a polyetherimide.

Example 82

The cylinder head as recited in any one of examples 70 to 81, wherein the cylinder head is injection molded.

Example 83

The cylinder head as recited in any one of examples 70 to 82, wherein the cylinder head comprises a flange that projects out from an outer perimeter of the side wall.

Example 84

The cylinder head as recited in example 83, wherein the flange comprises a shoulder that extends out from the outer perimeter of the side wall away from a central axis of the cylinder head that is oriented along the longitudinal direction, and the flange further comprises a lip that extends out from the shoulder in a direction that is defined from the first end to the second end.

Example 85

The cylinder head as recited in example 24, wherein the lip is spaced from the side wall such that an air gap is defined between the side wall and the lip.

Example 86

The cylinder head as recited in any one of examples 70 to 85, further comprising a closure member that defines the inner head surface and the outer head surface, wherein the side wall defines an outer side surface that extends from the closure member so as to define an interior space of the cylinder head.

Example 87

The cylinder head as recited in example 86, wherein the cylinder head further defines both the inlet and the outlet that are open to the interior space.

Example 88

The cylinder head as recited in any one of examples 86 to 87, wherein the outer side surface is substantially smooth.

Example 89

The cylinder head as recited in any one of examples 86 to 87, wherein the cylinder head defines a plurality of slots that extend into the outer side surface so as to define projections separated by respective ones of the slots along an outer perimeter of the side wall.

Example 90

The cylinder head as recited in example 89, wherein the projections and slots are alternatingly arranged along a plane that is oriented normal to the longitudinal direction and intersects the side wall.

Example 91

The cylinder head as recited in any one of examples 89 to 90, wherein the projections are equidistantly spaced about the perimeter of the side wall.

Example 92

The cylinder head as recited in any one of examples 70 to 91, wherein the side wall is monolithic and homogenous with inner head surface and outer head surface.

Example 93

The cylinder head as recited in any one of examples 70 to 92, further comprising an intake valve that allows fluid to flow into the cylinder head under negative pressure, and prevents fluid from flowing from the cylinder head out the inlet under positive pressure.

Example 94

The cylinder head as recited in any one of examples 70 to 93, further comprising discharge valve that allows fluid to flow out of the cylinder head through the outlet under positive pressure, and prevents fluid from flowing into the cylinder head from the outlet under negative pressure.

Example 95

The cylinder head as recited in any one of examples 70 to 94, wherein the cylinder head defines an inner surface configured to interface with the cylinder body when the cylinder head is attached to the cylinder body, and the cylinder head further comprises a compressible gasket at the inner surface.

Example 96

The cylinder head as recited in example 95, wherein the gasket is elastomeric.

Example 97

The cylinder head as recited in any one of examples 95 to 96, wherein the gasket is overmolded by the cylinder head.

Example 98

The cylinder head as recited in any one of examples 70 to 97, wherein the cylinder head comprises a plurality of stiffening ribs that project out from the outer head surface.

Example 99

The cylinder head as recited in example 98, wherein the ribs extend radially outward from a common hub.

Example 100

The cylinder head as recited in example 99, wherein the common hub defines a central wall.

Example 101

The cylinder head as recited in example 100, wherein the common hub is cylindrical about the central head axis.

Example 102

The cylinder head as recited in example 101, wherein a central axis of the common hub is coincident with the central head axis.

Example 103

The cylinder head as recited in any one of examples 99 to 102, wherein the ribs are equidistantly circumferentially spaced from each other about the common hub.

Example 104

The cylinder head as recited in any one examples 99 to 108, wherein the ribs define a height from the outer head surface, and the height tapers toward the outer head surface in a direction away from the common hub.

Example 105

The cylinder head as recited in any one of examples 98 to 104, wherein the ribs terminate without overhanging an outer perimeter of the outer head surface.

Example 106

The cylinder head as recited in any one of examples 98 to 105, wherein the ribs are planar along respective planes that include the longitudinal direction L.

Example 107

The cylinder head as recited in any one of examples 98 to 106, wherein the ribs comprise a first plurality of ribs, and the cylinder head further comprises at least one circumferential rib that intersects at least one of the first plurality of ribs.

Example 108

The cylinder head as recited in example 107, wherein the at least one circumferential rib intersects each of the first plurality of ribs.

Example 109

The cylinder head as recited in any one of examples 107 to 108, wherein the first plurality of ribs extend radially outward from a common hub, the at least one circumferential rib includes an outer circumferential rib and an inner circumferential rib disposed between the common hub and the outer circumferential rib.

Example 110

The cylinder head as recited in example 109, wherein the inner and outer circumferential ribs are concentric about the common hub.

Example 111

The cylinder head as recited in any one of examples 98 to 106, wherein the cylinder head defines at least one pocket that extends into the outer head surface.

Example 112

The cylinder head as recited in example 111, wherein the at least one pocket terminates in the cylinder head without extending through the inner head surface.

Example 113

The cylinder head as recited in any one of examples 111 to 112, wherein the at least one pocket is disposed between adjacent ones of the ribs.

Example 114

The cylinder head as recite in example 113, wherein the at least one pocket comprises plurality of pockets that extend into the outer head surface at respective locations between different pairs of adjacent ones of the ribs.

Example 115

The cylinder head as recited in any one of examples 70 to 97, wherein the cylinder head comprises at least one circumferential rib that extends out from the outer head surface.

Example 116

The cylinder head as recited in example 116, wherein the at least one circumferential rib includes an outer circumferential rib and an inner circumferential rib concentrically arranged with the outer circumferential rib.

Example 117

The cylinder head as recited in any one of examples 70 to 97, wherein the outer head surface is substantially smooth.

Example 118

The cylinder head as recited in example 117, wherein the cylinder head defines at least one pocket that extends into the outer head surface.

Example 119

The cylinder head as recited in example 118, wherein the at least one pocket terminates in the cylinder head without extending through the inner head surface.

Example 120

The cylinder head as recited in any one of examples 118 to 119, wherein the at least one pocket includes a pair of pockets elongate along a select direction perpendicular to the longitudinal direction, and the pockets of the pair of pockets are aligned with each other along the select direction.

The embodiments described in connection with the illustrated embodiments have been presented by way of illustration, and the present invention is therefore not intended to be limited to the disclosed embodiments. Furthermore, the structure and features of each the embodiments described above can be applied to the other embodiments described herein. Accordingly, those skilled in the art will realize that the invention is intended to encompass all modifications and alternative arrangements included within the spirit and scope of the invention, as set forth by the appended claims.

What is claimed is:

1. A compressor comprising:

a cylinder body defining an outer wall having an inner body surface and an outer body surface opposite the inner body surface, wherein the inner body surface partially defines a cylinder chamber, and the cylinder body defines a first end and an open second end opposite the first end;

a cylinder head supported by the cylinder body at the second end, the cylinder head defining an inner head surface that faces the cylinder chamber, an outer head surface that is opposite the inner head surface along a central head axis, and a side wall configured to attach to the cylinder body, wherein the outer head surface defines a concavity along at least one direction; and a piston supported in the cylinder chamber and movable along a longitudinal direction along an intake stroke that creates negative pressure in the cylinder chamber so as to draw fluid into the cylinder chamber through an inlet, and a discharge stroke that creates positive pressure in the cylinder chamber so as to force fluid out of the cylinder chamber through an outlet, wherein at least one of the inlet and the outlet is defined by the cylinder head, wherein the concavity extends through a plane that is normal to the longitudinal direction and that intersects the outer head surface, wherein the concavity has a width along the plane, along a first direction perpendicular to the longitudinal direction, wherein the width is at least half of an outer dimension of the cylinder head that extends parallel the width, the outer di mension of the cylinder head extending from a first side wall of the cylinder head to a second side of the cylinder head opposite the first side wall, intersecting the central head axis.

2. The compressor as recited in claim 1, wherein the concavity is straight and linear along a second direction that is perpendicular to both the first direction and the longitudinal direction.

3. The compressor as recited in claim 1, wherein the at least one direction comprises a second direction that is perpendicular to the longitudinal direction and angularly offset with respect to the first direction.

4. The compressor as recited in claim 1, wherein the concavity defines a round perimeter in a plane that is normal to the longitudinal direction.

5. The compressor as recited in claim 4, wherein the round perimeter is circular.

6. The compressor as recited in claim 1, wherein the cylinder head comprises a polymer.

7. The compressor as recited in claim 6, wherein the polymer further comprises glass particles embedded therein.

8. The compressor as recited in claim 1, wherein the cylinder head comprises a plurality of stiffening ribs that project out from the outer head surface.

9. A refrigeration system comprising:

the compressor as recited in claim 1;

a condenser that receives the fluid output from the compressor that removes heat from the fluid, causing the fluid to enter a liquid phase;

an expansion valve that decreases a pressure of the fluid; and an evaporator whereby the fluid removes heat from a space to be cooled, thereby causing the fluid to enter a gaseous phase, wherein the compressor is configured to draw the gaseous phase fluid is into the inlet of the compressor from the evaporator.

10. A cylinder head configured to be mounted onto a compressor body of the type that contains a compressor chamber, the cylinder head comprising:

an inner head surface that is configured to face the cylinder head;

an outer head surface that is opposite the inner head surface along a longitudinal direction, wherein the cylinder head defines a central head axis that extends centrally through the inner head surface and the outer head surface along the longitudinal direction; and a side wall that is configured to attach to the compressor body, wherein the cylinder head defines at least one of a fluid inlet and a fluid outlet, and the outer head surface defines a concavity along at least one direction wherein the concavity extends through a plane that is normal to the longitudinal direction and that intersects the outer head surface, wherein the concavity has a width along a first direction perpendicular to the longitudinal direction, and the width is at least half of a dimension of the cylinder head that is parallel the width and that extends between by opposed locations of the side wall along a direction that intersects the central head axis.

11. The cylinder head of claim 10, wherein the concavity is straight and linear along a second direction that is perpendicular to both the first direction and the longitudinal direction.

12. The cylinder head of claim 10, wherein the at least one direction comprises a second direction that is perpendicular to the longitudinal direction and angularly offset with respect to the first direction.

13. The cylinder head of claim 12, wherein the second direction is perpendicular to the longitudinal direction.

14. The cylinder head of claim 12, wherein the concavity defines a round perimeter in a plane that is normal to the longitudinal direction.

15. The cylinder head of claim 14, wherein the round perimeter is circular.

16. The cylinder head of claim 12, wherein the concavity is dish-shaped.

17. The cylinder head of claim 10, wherein the concavity is centered about a central head axis.

18. The cylinder head of claim 10, wherein the cylinder head comprises a polymer.

19. The cylinder head of claim 18, wherein the polymer further comprises glass particles embedded therein.

* * * * *